US005647921A

United States Patent [19]

Odagawa et al.

[11] Patent Number: 5,647,921

[45] Date of Patent: Jul. 15, 1997

[54] PROCESS FOR PRODUCING AND AMORPHOUS ALLOY RESIN

[75] Inventors: Kenji Odagawa; Hiroshi Watanabe, both of Sodegaura, Japan

[73] Assignee: Mitsui Petrochemical Industries, Ltd., Tokyo, Japan

[21] Appl. No.: 636,822

[22] Filed: Apr. 23, 1996

Related U.S. Application Data

[63] Continuation of Ser. No. 292,970, Aug. 22, 1994, abandoned.

[30] Foreign Application Priority Data

Aug. 23, 1993 [JP] Japan ..... 5-207677
Mar. 10, 1994 [JP] Japan ..... 6-40049

[51] Int. Cl.[6] ..... C22C 45/02

[52] U.S. Cl. ..... 148/561; 148/304; 148/403; 164/46; 164/463

[58] Field of Search ..... 148/304, 403, 148/561; 164/46, 463

[56] References Cited

U.S. PATENT DOCUMENTS

| | | | |
|---|---|---|---|
| 3,856,074 | 12/1974 | Kavesh | 164/87 |
| 3,862,658 | 1/1975 | Bedell | 164/87 |
| 4,202,404 | 5/1980 | Carlson | 164/423 |
| 4,386,648 | 6/1983 | Hilzinger et al. | 164/463 |
| 4,527,614 | 7/1985 | Masumoto et al. | 164/463 |
| 5,043,029 | 8/1991 | Liebermann et al. | 148/403 |
| 5,096,513 | 3/1992 | Sawa et al. | 148/304 |

FOREIGN PATENT DOCUMENTS

| | | |
|---|---|---|
| 0038584 | 10/1981 | European Pat. Off. . |
| 0090973 | 10/1983 | European Pat. Off. . |
| 0099599 | 2/1984 | European Pat. Off. . |
| 0463226 | 1/1992 | European Pat. Off. . |

OTHER PUBLICATIONS

English Language Abstract of JP–A–79342, Mar. 24, 1989.
English Language Abstract of JP–A–219009, Sep. 26, 1991.
English Language Abstract of JP–A–165261, Dec. 23, 1980.
English Language Abstract of *J. Japan Inst. Metals,* vol. 53, No. 2, 1989.
English Language Abstract of *J. Magnetic Soc. Japan,* vol. 13, No. 2, 1989.
Yoshigawa, et al., *Materials Sci. Engin.,* A133, (1991), pp. 176–179.
*Materials Science and Engineering,* part 1, Aug. 13–17, 1990, Yoshiyawa, et al., pp. 176–179.
Patent Abstract of Japan, unexamined applications, M section, vol. 5, No. 39, Mar. 14, 1981, p. 115 M 59 (JP–A–55 165261).

*Primary Examiner*—George Wyszomierski
*Attorney, Agent, or Firm*—Sherman and Shalloway

[57] ABSTRACT

A process for producing an amorphous alloy ribbon by the single roll method is disclosed, which comprises injecting through a slot disposed at a nozzle tip a molten alloy having the composition represented by the general formula:

$$(Fe_{1-a}M_a)_{100-x-y-z-b}Cu_xSi_yB_zM'_b$$

wherein M is Co and/or Ni, M' is at least one element selected from the group consisting of Nb, Mo, W and Ta, and a, x, y, z and b satisfy the relationships: $0 \leqq a \leqq 0.1$, $0.5 \leqq x \leqq 2$ (atomic %), $5 \leqq y \leqq 20$ (atomic %), $5 \leqq z \leqq 11$ (atomic %), $14 \leqq y+z \leqq 25$ (atomic %) and $2 \leqq b \leqq 5$ (atomic %), provided that the ratio of y to z (y/z) is in the range of $0.5 \leqq y/z \leqq 3$, onto a cooling wheel comprising a Cu alloy containing Be in an amount of 0.05 to 3.0% by weight. This process is advantageous in that the position of peel of the amorphous alloy ribbon formed on the cooling wheel can be controlled.

2 Claims, 2 Drawing Sheets

PROCESS FOR PRODUCING AND AMORPHOUS ALLOY RESIN

This application is a continuation of application Ser. No. 08/292,970, filed Aug. 22, 1994, abandoned.

FIELD OF THE INVENTION

The present invention relates to a process for producing an amorphous alloy ribbon by a single roll liquid quenching method.

BACKGROUND OF THE INVENTION

Various types of soft magnetic alloys exhibiting high saturation magnetic flux densities have been developed as magnetic core materials for use in transformers, magnetic heads, choke coils or the like in recent years.

For example, Japanese Patent Publication No. 4(1992)-4393 discloses a soft magnetic alloy having the composition represented by the general formula:

$$(Fe_{1-a}M_a)_{100-x-y-z-b}Cu_xSi_yB_zM'_b$$

wherein M is Co and/or Ni, M' is at least one element selected from the group consisting of Nb, W, Ta, Zr, Hf, Ti and Mo and a, x, y, z and b satisfy the relationships: $0 \leqq a \leqq 0.5$, $0.1 \leqq x \leqq 3$, $0 \leqq y \leqq 30$, $0 \leqq z \leqq 25$, $5 \leqq y+z \leqq 30$ and $0.1 \leqq b \leqq 30$, the soft magnetic alloy having a texture, at least 50% of which is composed of fine crystal particles having an average particle size of 1000 Å or less, while the balance is substantially amorphous. The microcrystalline soft magnetic alloy is described as exhibiting low core loss and low magnetostriction.

It is fully described in Japanese Patent Publication No. 4(1992)-4393, Y. Yoshizawa and K. Yamauchi: Journal of the Magnetics Society of Japan, 13, 231 (1989), Y. Yoshizawa and K. Yamauchi: Journal of the Japan Institute of Metals, 53, 241 (1989) and Y. Yoshizawa and K. Yamauchi: Material Science and Engineering, A133, 176 (1991) that, of the microcrystalline soft magnetic alloys having the above composition, those having the composition of the above formula in which, however, M' is at least one element selected from the group consisting of Nb, W, Ta and Mo and a, x, y, z and b satisfy the relationships: a=0, $0.5 \leqq x \leqq 2$, $5 \leqq y \leqq 20$, $5 \leqq z \leqq 11$, $14 \leqq y+z \leqq 25$ and $2 \leqq b \leqq 5$, have not only especially high saturation magnetic flux density as well as low core loss and low magnetostriction values.

The fundamental process for producing the above microcrystalline soft magnetic alloy is disclosed in Japanese Patent Laid-Open Publication No. 3(1991)-219009. The fundamental process comprises the step of quenching a melt having the above composition to thereby form an amorphous alloy and the step of conducting a heat treatment to thereby form fine crystal particles having an average particle size of 1000 Å or less. However, the particulars as to how each of the above steps is performed are not disclosed in the above publication. Further, with respect to the technology for mass-producing an amorphous alloy ribbon as a first step of the production of the microcrystalline soft magnetic alloy ribbon, any practical procedure is not known and it has been believed that the industrial mass-production of an amorphous alloy ribbon suitable for use in the production of the microcrystalline soft magnetic alloy ribbon is difficult.

The inventors have found that, in the production of the amorphous alloy ribbon having the above composition according to the single roll method, it is likely to spontaneously peel from the rotating cooling wheel, as compared with the Fe-Si-B alloy, and further the peel position is irregular, thereby causing the industrial mass-production thereof to be difficult. The irregular position of peel of the ribbon from the cooling wheel causes the ribbon recovery by winding or the like to be difficult, with the result that the productivity of the ribbon is gravely lowered.

For avoiding the above problem, U.S. Pat. No. 3,856,074 proposed a process in which a metal filament formed on the surface of a cooling wheel is held by sandwiching the filament between the cooling wheel and a roller.

On the other hand, U.S. Pat. No. 3,862,658 proposed a process in which the duration of contact of the metal filament with a cooling wheel has been increased either by blowing gas jets against the metal filament formed on the surface of the cooling wheel or by sandwiching the metal filament between a belt or a roller and the cooling wheel.

Further, U.S. Pat. No. 4,202,404 proposed a process in which a metal filament is held by sandwiching the metal filament between a cooling wheel and a flexible belt covering at least ⅓ of the surface of the cooling wheel. The specification of the patent discloses the use of a Cu alloy containing Be as a material of the cooling wheel.

All of the above conventional processes require introduction of special devices, thereby having a disadvantage that the increase in production cost is inevitable.

Moreover, Japanese Patent Laid-Open Publication No. 55(1980)-165261 discloses the use of a cooling wheel composed of, for example, a Cu-Ag alloy which has on its surface a coating of a metal such as Fe or Cr highly wettable with a molten metal, as a means for improving the adhesion between the ribbon and the cooling wheel. This proposal has, however, a drawback in the wear resistance of the cooling wheel and the production cost.

OBJECT OF THE INVENTION

The present invention has been made in view of the above prior art. The object of the present invention is to provide a process for producing an amorphous alloy ribbon by the single roll method, in which the amorphous alloy ribbon formed by injecting a molten alloy through a nozzle onto a cooling wheel satisfactorily adheres to the cooling wheel, so that the position at which the amorphous alloy ribbon is peeled from the cooling wheel can accurately be controlled.

SUMMARY OF THE INVENTION

Essentially, according to the present invention, there is provided a process for producing an amorphous alloy ribbon by a single roll method, which comprises injecting through a slot disposed at a nozzle tip a molten alloy having the composition represented by the general formula:

$$(Fe_{1-a}M_a)_{100-x-y-z-b}Cu_xSi_yB_zM'_b$$

wherein M is Co element and/or Ni element, M' is at least one element selected from the group consisting of Nb, Mo, W and Ta, and a, x, y, z and b satisfy the relationships: $0 \leqq a \leqq 0.1$, $0.5 \leqq x \leqq 2$ (atomic %), $5 \leqq y \leqq 20$ (atomic %), $5 \leqq z \leqq 11$ (atomic %), $14 \leqq y+z \leqq 25$ (atomic %) and $2 \leqq b \leqq 5$ (atomic %), provided that the ratio of y to z (y/z) is in the range of $0.5 \leqq y/z \leqq 3$, onto a cooling wheel comprising a Cu alloy containing Be in an amount of 0.05 to 3.0% by weight.

In the present invention, it is preferred that use be made of a molten alloy having the composition represented by the above general formula in which a=0.

Further, in the present invention, it is especially preferred that the ratio of y to z (y/z) of the alloy composition be in the range of $0.7 \leqq y/z \leqq 2$.

In the present invention, preferably, the production of the amorphous alloy ribbon is performed under the following conditions:

surface velocity (peripheral surface velocity) of the rotating cooling wheel (R):

$10 \leqq R \leqq 40$ (m/sec) (sec=second), wherein the surface velocity (peripheral surface velocity) of the rotating cooling wheel means the peripheral speed of the rotating cooling wheel which contacts with the molten alloy, and molten alloy injection pressure (P) (gauge):

$P \leqq 0.6$ (kgf/cm$^2$).

Still preferably, in the present invention, the production of the amorphous alloy ribbon is performed under the following conditions:

surface velocity of the cooling wheel (R):

$10 \leqq R \leqq 40$ (m/sec), casting temperature (Tc):

$1150 \leqq Tc \leqq 1600$ (°C.)

molten alloy injection pressure (P) (gauge):

$P \leqq 0.6$ (kgf/cm$^2$), slot width at the nozzle tip (d):

$0.2 \leqq d \leqq 0.9$ (mm), and gap between the nozzle tip and the cooling wheel (g):

$0.05 \leqq g \leqq 0.3$ (mm).

It is especially preferred in the present invention that the production of the amorphous alloy ribbon is performed under the following conditions: surface velocity of the cooling wheel (R):

$15 \leqq R \leqq 30$ (m/sec), casting temperature (Tc):

$1150 \leqq Tc \leqq 1500$ (°C.)

molten alloy injection pressure (P) (gauge):

$P \leqq 0.4$ (kgf/cm$^2$), slot width at the nozzle tip (d):

$0.3 \leqq d \leqq 0.6$ (mm), and gap between the nozzle tip and the cooling wheel (g):

$0.08 \leqq g \leqq 0.2$ (mm).

DETAILED DESCRIPTION OF THE INVENTION

The process for producing an amorphous alloy ribbon according to the present invention will now be described in more detail.

Figure 1:
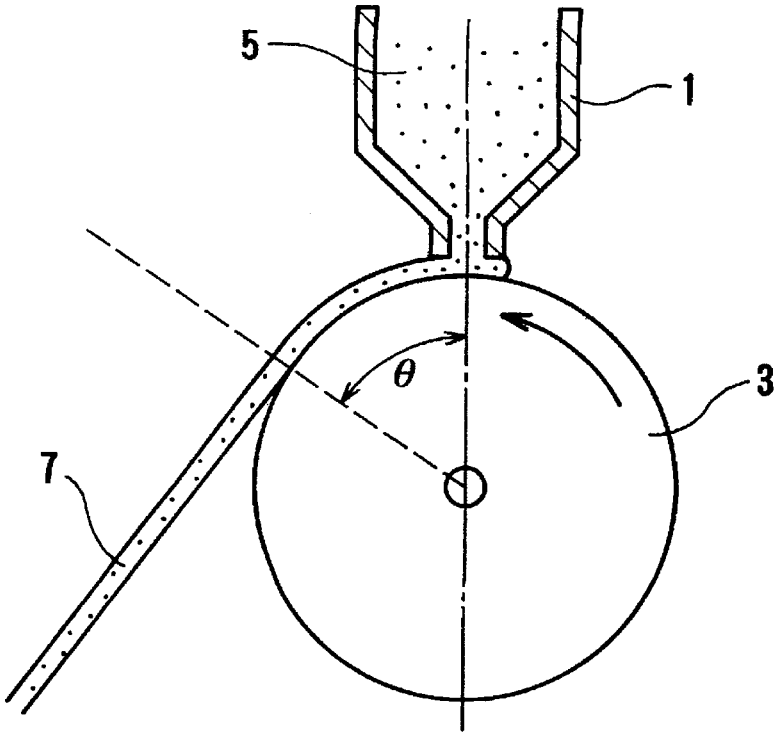
FIG. 1 is a conceptual view of the process for producing an amorphous alloy ribbon according to the present invention.
Figure 2:
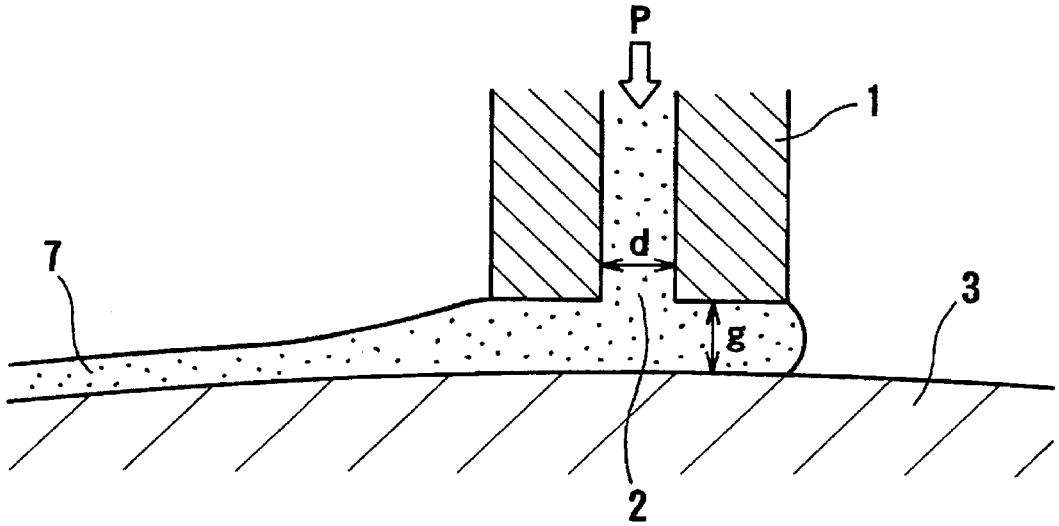
FIG. 2 is an enlarged cross-sectional view of a nozzle tip to be employed in the present invention.

FIG. 1 is a conceptual view of the process for producing an amorphous alloy ribbon according to the present invention, and FIG. 2 is an enlarged cross-sectional view of a nozzle tip to be employed in the present invention.

As shown in FIGS. 1 and 2, in the process for producing an amorphous alloy ribbon according to the present invention, a molten alloy 5 is injected through a slot 2 disposed at a tip of a nozzle 1 onto a rotating cooling wheel 3 to thereby form an amorphous alloy ribbon 7.

Figure 3:
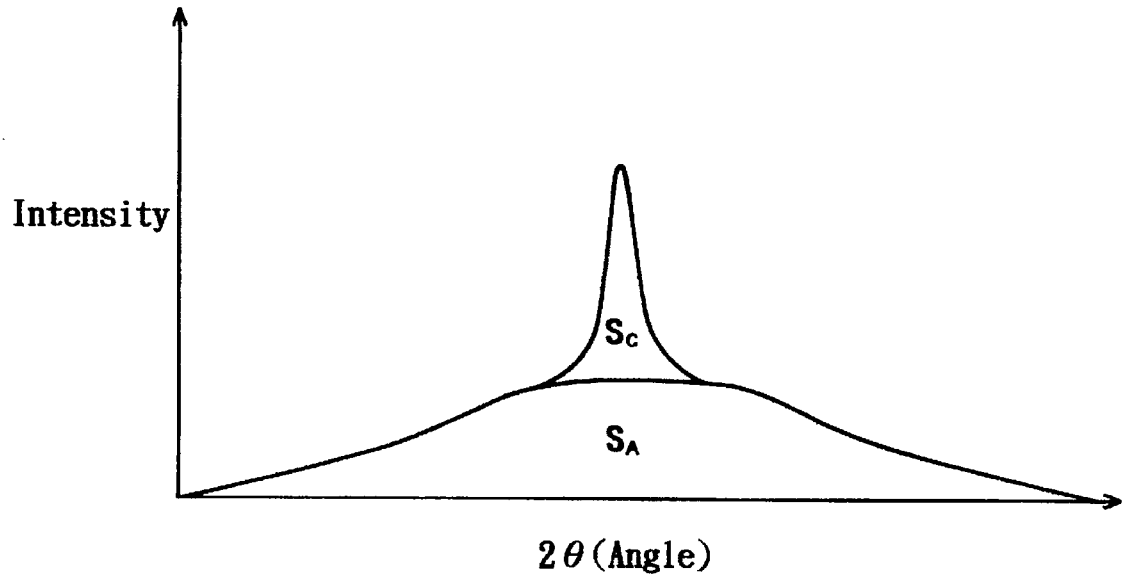
FIG. 3 is a conceptual view of an X-ray diffraction pattern taken from the free surface side of an amorphous alloy ribbon produced by the single roll method.

The terminology "amorphous alloy ribbon" used herein means the ribbon of alloy whose proportion of the crystalline (crystal) phase in the alloy, $X_C$ (%) (the volume fraction of the crystalline phase in the alloy structure), is 30% or less. The crystal content is defined by the formula:

$$X_C(\%) = \frac{S_C}{(S_C + S_A)} \times 100$$

wherein $S_C$ represents the area of diffraction peak ascribed to crystal phase and $S_A$ represents the area of broad diffraction pattern ascribed to amorphous phase in the X-ray diffraction pattern, as shown in FIG. 3, taken from the free side surface of the amorphous alloy ribbon produced according to the single roll method.

The amorphous alloy ribbon whose $X_C$ is 30% or less, can be automatically wound or easily slit because its mechanical strength is excellent. Heat treatment of the above amorphous alloy ribbon causes the same to create microcrystalline precipitates, and the resultant alloy ribbon has excellent magnetic properties. From the viewpoint that the amorphous alloy ribbon is stably mass-produced, it is preferred that the $X_C$ of the amorphous alloy ribbon of the present invention be 5% or less, especially substantially 0%.

The alloy suitable for use in the production of the amorphous alloy ribbon of the present invention is an Fe-base alloy represented by the general formula:

$$(Fe_{1-a}M_a)_{100-x-y-z-b}Cu_xSi_yB_zM'_b.$$

In the above general formula, M is Co (element) and/or Ni (element), and M' is at least one element selected from the group consisting of Nb, Mo, W and Ta. Further, x, y, z and b are expressed by atomic %.

Generally, a satisfies the relationship: $0 \leqq a \leqq 0.1$, preferably $0 \leqq a \leqq 0.05$, still preferably a=0.

Generally, x satisfies the relationship: $0.5 \leqq x \leqq 2$ (atomic %), preferably $0.5 \leqq x \leqq 1.5$ (atomic %).

Generally, y satisfies the relationship: $5 \leqq y \leqq 20$ (atomic %). Generally, z satisfies the relationship: $5 \leqq z \leqq 11$ (atomic %). Generally, b satisfies the relationship: $2 \leqq b \leqq 5$ (atomic %), preferably $2 \leqq b \leqq 4$ (atomic %).

Further, y and z satisfy the relationship: $14 \leqq y+z \leqq 25$ (atomic %). Besides the above compositional requirement, the atomic % ratio of y to z (y/z) of the alloy for use in the present invention satisfies the relationship: $0.5 \leqq y/z \leqq 3$, preferably $0.7 \leqq y/z \leqq 2$.

In addition to the elements included in the above general formula, the alloy for use in the present invention may contain elements selected from the group consisting of V, Cr, Mn, Ti, Zr, Hf, C, Ge, P, Ga, the elements of the Platinum Group and Au in an amount of up to, for example, 5 atomic %, according to necessity.

Each of the alloys having the above composition has high adhesion property to the cooling wheel described below. Moreover, an amorphous alloy ribbon having high saturation magnetic flux density and low magnetostriction can be produced from each of the alloys having the above composition.

The cooling wheel (the whole parts of the cooling wheel or at least a contacting surface of the cooling wheel with the molten alloy) 3 suitable for use in the present invention is composed of a Cu alloy containing Be in an amount of 0.05 to 3.0% by weight, preferably 0.1 to 2.0% by weight. The terminology "Cu alloy containing Be in an amount of 0.05 to 3.0% by weight" used herein means an alloy comprising Cu as a principal essential component and containing Be in an amount of 0.05 to 3.0% by weight, and accordingly encompasses not only a Cu-Be alloy comprising 0.05 to 3.0% by weight of Be and the balance of Cu but also alloys each composed of Cu, 0.05 to 3.0% by weight of Be and up to 1% by weight of other elements, for example such as Fe, Co and Ni. Of the above alloys, Cu-Be alloys each comprising 0.05 to 3.0% by weight, preferably 0.1 to 2.0% by weight of Be and the balance of Cu are especially preferred in the present invention.

The cooling wheel suitable for use in the present invention is excellent in the property of adhesion to the alloy having the above composition because it comprises a Cu alloy containing Be in an amount of 0.05 to 3.0% by weight. Thus, spontaneous peeling of the amorphous alloy ribbon from the cooling wheel is less likely (large sticking angle), so that it is easy to accurately control the position at which the amorphous alloy ribbon is peeled from the cooling wheel. Further, since the property of adhesion between the cooling wheel and the molten alloy of the above composition is excellent, the heat conductivity therebetween at the interface is so high that the cooling rate of the molten alloy is high. Therefore, the amorphous alloy ribbon can easily be produced under standard conditions, and hence industrial mass-production of the amorphous alloy ribbon is feasible.

The cooling wheel for use in the present invention is excellent in the molten alloy cooling performance, because it is composed of a Cu alloy having high heat conductivity. Further, the above Cu alloy containing Be in an amount of 0.05 to 3.0% by weight has high Vickers hardness, so that the wear resistance of the cooling wheel is excellent.

The cooling wheel for use in the present invention may be provided with forced cooling means for increasing the cooling capacity of the cooling wheel, e.g., means for passing a liquid such as water inside the cooling wheel.

In the present invention, it is preferred that the surface velocity (R) of the rotating cooling wheel 3 be in the range of 10 to 40 m/sec, especially 15 to 35 m/sec in the injection of the molten alloy 5 onto the cooling wheel 3 being rotated.

When the surface velocity (R) of the cooling wheel 3 is rotated in the range of 10 to 40 m/sec in the injection of the molten alloy 5 onto the rotating cooling wheel 3, a cooling rate sufficient to form the Fe-base amorphous alloy ribbon can be obtained and the formed ribbon is not peeled from the cooling wheel by centrifugal force.

In the present invention, it is preferred that the injection pressure (P) (gauge pressure) at which the molten alloy 5 is injected through a slot 2 disposed at the tip of a nozzle 1 be not greater than 0.6 kgf/cm$^2$ (0 to 0.6 kgf/cm$^2$), especially not greater than 0.5 kgf/cm$^2$ (0 to 0.5 kgf/cm$^2$) and still especially not greater than 0.4 kgf/cm$^2$ (0 to 0.4 kgf/cm$^2$). When the injection pressure (P) (gauge pressure) at which the molten alloy 5 is injected through a slot 2 disposed at the tip of a nozzle 1 be not greater than 0.6 kgf/cm$^2$, the formed amorphous alloy ribbon has a thickness ensuring satisfactory adhesion to the cooling wheel. Further, the obtained thickness is such that the cooling rate satisfactory for forming the desired amorphous alloy ribbon is ensured.

Although the casting temperature (Tc) as the temperature at which the molten alloy is injected depends on the composition of the amorphous alloy ribbon to be produced, it is preferably in the range of 1150° to 1600° C., still preferably 1150° to 1500° C.

When the casting temperature (Tc) is in range of 1150° to 1600° C., the viscosity of the molten alloy is so low that the molten alloy can easily be injected through a nozzle. Further, the molten alloy injected onto the cooling wheel can have a cooling rate satisfactory for forming the amorphous alloy ribbon.

The alloy may be melted by, for example, high frequency heating. The injection of the molten alloy is generally performed under the pressure of an inert gas, such as Ar gas.

The nozzle 1 for use in the present invention is provided at its tip with a slot 2. The molten alloy is injected through the slot 2.

The width (d) of the slot 2 at the tip of the nozzle 1 is preferred to be in the range of 0.2 to 0.9 mm, especially 0.3 to 0.6 mm.

When the width (d) of the slot 2 at the tip of the nozzle 1 is in the range of 0.2 to 0.9 mm, the formed amorphous alloy ribbon has a thickness ensuring satisfactory adhesion to the cooling wheel. Further, a thickness ensuring a cooling rate satisfactory for forming the amorphous alloy ribbon can be obtained.

The gap (g) between the nozzle tip at which the slot 2 is disposed and the cooling wheel 3 is preferred to be in the range of 0.05 to 0.3 mm, especially 0.08 to 0.2 mm. When the gap (g) between the tip of the nozzle 1 and the cooling wheel 3 is in the range of 0.05 to 0.3 mm, the formed amorphous alloy ribbon has a thickness ensuring satisfactory adhesion to the cooling wheel 3. Further, the danger that a solidification front of the molten alloy contacts the nozzle to thereby break the tip of the nozzle can be avoided at the above gap.

The production of the amorphous alloy ribbon of the present invention can be performed in, for example, vacuum, air or an inert atmosphere such as nitrogen, argon or the like. In the industrial mass-production, it is preferred from the viewpoint of the simplification of production equipment that the operation be performed in air. The production may be performed while blowing an arbitrary gas such as He or $N_2$ gas to the nozzle tip and the cooling wheel.

In the process of the present invention, the formed amorphous alloy ribbon satisfactorily sticks to the cooling wheel, so that the peel position can be controlled by forced peeling with an air knife, etc. The amorphous ribbon of, for example, an Fe-Cu-Si-B-Nb alloy can be industrially mass-produced according to the present invention. The thus produced amorphous alloy ribbon may be heat-treated to form fine crystal particles, thereby obtaining a microcrystalline soft magnetic alloy.

EFFECT OF THE INVENTION

A molten alloy having a specific composition is used in combination with a cooling wheel comprising a Cu alloy containing Be in a specified amount in the process for producing an amorphous alloy ribbon according to the present invention. Hence, the adhesion between the formed amorphous alloy ribbon and the cooling wheel is so excellent that the position of peel of the amorphous alloy ribbon from the cooling wheel can be accurately controlled. Consequently, the recovery of the amorphous alloy ribbon by winding, etc. is facilitated to thereby realize mass-production of the amorphous alloy ribbon. Moreover, the heat conduction between the molten alloy and the cooling wheel at the interface is so high that the rate of cooling of the molten alloy is high. Therefore, the amorphous alloy ribbon can easily be produced under standard conditions, and industrial mass-production thereof is feasible.

EXAMPLES

The present invention will now be illustrated in more detail with reference to the following Examples, which should not be construed as limiting the scope of the invention.

Example 1

Alloys of various compositions were formed into alloy ribbons and the sticking angle (θ) of each of the alloy ribbons was measured as means for evaluating the adhesion property of the alloy ribbon to the cooling wheel in order to find the compositions optimum for producing the amorphous alloy ribbon. Further, the X-ray diffraction pattern of each of the formed alloy ribbons was obtained, thereby investigating the presence or absence of crystal phase in the ribbon.

In particular, an alloy ribbon having a thickness of about 25 μm was produced from each of the alloys having the respective compositions represented by the formula:

$$Fe_{96-y-z}Cu_1Si_yB_zNb_3 \text{ (atomic \%)}$$

wherein y and z are specified in Table 1, under the below specified conditions according to the single roll method, during which the sticking angle (θ) was measured. Further, the X-ray diffraction pattern of each of the alloy ribbons was obtained.

The results are shown in Table 1.

The molten alloy injection pressure (P) was finely regulated with respect to each of the compositions so as for the thickness of the ribbon to be about 25 μm.

The sticking angle (θ) of each of the alloy ribbons was determined by photographing the condition of the alloy ribbon in production with a video camera and measuring the sticking angle (θ) on the video picture. Referring to FIG. 1, the sticking angle (θ) is defined as an angle formed by a line passing the center of the slot of the nozzle and the center of the cooling wheel and a line passing the point at which the formed alloy ribbon begins to peel from the cooling wheel and the center of the cooling wheel. The upper limit for the quantitative observation of the sticking angle (θ) was about 60°, so that, when the observed sticking angle exceeded 60°, it was indicated as ">60°".

Production Conditions

Material of the cooling wheel:

Cu-Be alloy containing 0.4% by weight of Be,

Surface velocity of the rotating cooling wheel (R):

30 (m/sec),

Casting temperature (Tc):

1450 (°C.),

Molten alloy injection pressure (P) (gauge):

0.30 to 0.35 (kgf/cm2),

Slot width at the nozzle tip (d):

0.3 (mm),

Gap between the nozzle tip and the cooling wheel (g):

0.2 (mm), and

Atmosphere:

air.

The results showed that all the alloys having the compositions specified in the column "Example 1" of Table 1 exhibited sticking angles (θ) of more than 60°, demonstrating excellent property of adhesion between each of the ribbons and the cooling wheel. Further, the X-ray diffractometry showed that all the formed ribbons were substantially amorphous.

Comparative Example 1

Alloy ribbons each having a thickness of about 25 μm were produced in the same manner as in Example 1, except that use was made of alloys having Si and B contents specified in Table 1. The sticking angle (θ) of each of the alloy ribbons on the roll was measured, and the X-ray diffraction pattern of each of the produced alloy ribbons was obtained.

The results are shown in Table 1.

The alloys having the compositions specified in the column "Comparative example 1" of Table 1 exhibited small sticking angles (θ), which demonstrated poor adhesion between the ribbon and the cooling wheel.

Further, the X-ray diffractometry showed that each of the produced alloy ribbons contained crystal phase in an amount of at least 30%.

Comparative Example 2

Alloy ribbons each having a thickness of about 25 μm were produced in the same manner as in Example 1, except that a copper-made cooling wheel was used as the cooling wheel, with the use of four species selected from among the alloy compositions employed in Example 1. The sticking angle (θ) of each of the alloy ribbons on the wheel was measured, and the X-ray diffraction pattern of each of the produced alloy ribbons was obtained.

The results are shown in Table 1.

The alloy ribbons produced under the conditions specified in the column "Comparative example 2" of Table 1 exhibited small sticking angles (θ), which demonstrated poor adhesion between the ribbon and the cooling wheel. Further, the X-ray diffractometry showed that each of the produced alloy ribbons contained crystal phase in an amount of at least 30%.

TABLE 1

| | Material of cooling wheel | Amount of Si (y) atomic % | Amount of B (z) atomic % | y/z | y + z | Interjection pressure (gauge) (P) kgf/cm$^2$ | Sticking angle (°) | Xc (%) *2 |
|---|---|---|---|---|---|---|---|---|
| Ex. 1 | Cu—Be | 8 | 9 | 0.89 | 17 | 0.35 | >60 | 5 |
| | *1 | 8 | 11 | 0.73 | 19 | 0.35 | >60 | 0 |
| | | 11 | 9 | 1.2 | 20 | 0.30 | >60 | 0 |
| | | 12 | 8 | 1.5 | 20 | 0.35 | >60 | 0 |
| | | 13.5 | 9 | 1.5 | 22.5 | 0.30 | >60 | 0 |
| | | 14 | 5 | 2.8 | 19 | 0.30 | >60 | 0 |
| Comp. | Cu—Be | 2 | 17 | 0.12 | 19 | 0.30 | 34 | 50 |
| Ex. 1 | *1 | 4 | 13 | 0.31 | 17 | 0.35 | 41 | 40 |
| | | 18 | 5 | 3.6 | 23 | 0.30 | 32 | 40 |
| | | 20 | 4 | 5.0 | 24 | 0.30 | 28 | 40 |
| Comp. | Cu | 8 | 9 | 0.89 | 17 | 0.35 | 28 | 60 |
| Ex. 2 | | 8 | 11 | 0.73 | 19 | 0.30 | 32 | 50 |
| | | 11 | 9 | 1.2 | 20 | 0.30 | 25 | 55 |
| | | 14 | 5 | 2.8 | 19 | 0.30 | 22 | 50 |

*1 Cu alloy containing 0.4% by weight of Be

*2 The Xc (%) of the alloy ribbon was calculated according to the formula:

$$X_C(\%) = \frac{S_C}{(S_C + S_A)} \times 100$$

wherein $S_C$ represents the area of diffraction peak ascribed to crystal phase and $S_A$ represents the area of broad diffraction pattern ascribed to amorphous phase in the X-ray diffraction pattern taken from the free side surface of the alloy ribbon.

It is apparent from Table 1 that production of an amorphous alloy ribbon in which an alloy having the composition satisfying the relationships: $14 \leqq y+z \leqq 25$ (atomic %) and $0.5 \leqq y/z \leqq 3$ (wherein y and z respectively represent Si and B contents) is applied to a cooling wheel comprising a Cu-Be alloy containing Be in an amount of 0.05 to 3.0% by weight according to the single roll method, leads to excellent adhesion property between the ribbon and the cooling wheel and thus to a large sticking angle.

Example 2

Amorphous alloy ribbons were produced from the alloy of the composition represented by the formula: $Fe_{73.5}Cu_1Si_{13.5}B_9Nb_3$ (atomic %) according to the single roll method in which the casting temperature (Tc), the surface velocity of the cooling wheel (R) and the injection pressure of the molten alloy (P) were altered as specified in Table 2 while the other production conditions were set as indicated below. The sticking angle (θ) of each of the alloy ribbons on the roll and the thickness (h) of each of the formed alloy ribbons were measured in the same manner as in Example 1. Further, the $X_C$ of each of the obtained alloy ribbons was determined in the same manner as in Example 1.

The results are shown in Table 2.

Production Conditions

Material of the cooling wheel:

Cu-Be alloy containing 0.4% by weight of Be,

Slot width at the nozzle tip (d):

0.3 (mm),

Gap between the nozzle tip and the cooling wheel (g):

0.2 (mm), and

Atmosphere:

air.

TABLE 2

| Casting temp. (Tc) °C. | Surface velocity of cooling wheel (R) m/s | Injection pressure (P) (gauge) kgf/cm$^2$ | Sticking angle (θ) ° | Thickness of alloy ribbon (h) μm | Xc (%) of alloy ribbon *1 |
|---|---|---|---|---|---|
| Example 2 | | | | | |
| 1500 | 25 | 0.30 | 55 | 33 | 0 |
| 1500 | 25 | 0.40 | 40 | 38 | 0 |
| 1500 | 30 | 0.35 | >60 | 30 | 0 |
| 1450 | 25 | 0.30 | >60 | 29 | 0 |
| 1450 | 30 | 0.30 | >60 | 25 | 0 |
| 1450 | 30 | 0.40 | >60 | 27 | 0 |
| 1400 | 30 | 0.40 | >60 | 25 | 0 |
| 1330 | 20 | 0.30 | >60 | 33 | 0 |
| 1330 | 25 | 0.40 | >60 | 34 | 0 |
| 1330 | 30 | 0.40 | >60 | 30 | 0 |

*1 Determined in the same manner as described in note *2 of Table 1.

Example 3

Amorphous alloy ribbons were produced from the alloy of the composition represented by the formula:

$$Fe_{76}Cu_1Si_{11}B_9Nb_3 \text{(atomic \%)}$$

according to the single roll method in the same manner as in Example 2, except that the casting temperature (Tc), the surface velocity of the cooling wheel (R) and the injection pressure of the molten alloy (P) were altered as specified in Table 3. The sticking angle (θ) of each of the alloy ribbons on the roll and the thickness (h) of each of the formed alloy ribbons were measured in the same manner as in Example 1. Further, the crystal content ($X_C$) of each of the obtained alloy ribbons was determined in the same manner as in Example 1.

The results are shown in Table 3.

TABLE 3

| Casting temp. (Tc) °C. | Surface velocity of cooling wheel (R) m/s | Injection pressure (P) (gauge) kgf/cm$^2$ | Sticking angle (θ) ° | Thickness of alloy ribbon (h) μm | Xc (%) of alloy ribbon *1 |
|---|---|---|---|---|---|
| Example 3 | | | | | |
| 1500 | 25 | 0.30 | >60 | 32 | 0 |
| 1500 | 25 | 0.40 | >60 | 37 | 0 |
| 1500 | 30 | 0.35 | >60 | 33 | 0 |
| 1450 | 25 | 0.30 | >60 | 30 | 0 |
| 1450 | 30 | 0.30 | >60 | 24 | 0 |
| 1450 | 30 | 0.40 | >60 | 26 | 0 |
| 1400 | 25 | 0.40 | >60 | 33 | 0 |
| 1400 | 30 | 0.40 | >60 | 26 | 0 |
| 1330 | 20 | 0.30 | >60 | 33 | 0 |
| 1300 | 25 | 0.35 | >60 | 30 | 0 |
| 1300 | 25 | 0.40 | 55 | 33 | 0 |

*1 Determined in the same manner as described in note *2 of Table 1.

Example 4

Amorphous alloy ribbons were produced from the alloy of the composition represented by the formula:

$Fe_{79}Cu_1Si_8B_9Nb_3$ (atomic %)

according to the single roll method in the same manner as in Example 2, except that the casting temperature (Tc), the surface velocity of the cooling wheel (R) and the injection pressure of the molten alloy (P) were altered as specified in Table 4. The sticking angle (θ) of each of the alloy ribbons on the roll and the thickness (h) of each of the formed alloy ribbons were measured in the same manner as in Example 1. Further, the crystal content ($X_C$) of each of the obtained alloy ribbons was determined in the same manner as in Example 1.

The results are shown in Table 4.

TABLE 4

| Casting temp. (Tc) °C. | Surface velocity of cooling wheel (R) m/s | Injection pressure (P) (gauge) kgf/cm$^2$ | Sticking angle (θ) ° | Thickness of alloy ribbon (h) μm | Xc (%) of alloy ribbon *1 |
|---|---|---|---|---|---|
| Example 4 | | | | | |
| 1500 | 25 | 0.30 | >60 | 32 | 10 |
| 1500 | 30 | 0.35 | >60 | 26 | 5 |
| 1450 | 30 | 0.30 | >60 | 23 | 0 |
| 1400 | 30 | 0.30 | >60 | 22 | 0 |
| 1400 | 30 | 0.40 | >60 | 26 | 5 |
| 1350 | 30 | 0.40 | >60 | 26 | 0 |

*1 Determined in the same manner as described in note *2 of Table 1.

Tables 2 to 4 show that especially excellent adhesion property is obtained between the amorphous alloy ribbon and the cooling wheel when the surface velocity (R) of the cooling wheel and the injection pressure (P) satisfy the relationships $10 \leqq R \leqq 40$ (m/sec) and $P \leqq 0.6$ kgf/cm$^2$ (gauge pressure), respectively.

Examples 5 to 20

Amorphous alloy ribbons were produced from the alloys of the compositions specified in Table 5 under the below specified conditions according to the single roll method. The sticking angle (θ) of each of the alloy ribbons on the roll was measured in the same manner as in Example 1. Further, the $X_C$ of each of the alloy ribbons obtained in Examples 5 to 20 was determined in the same manner as in Example 1. Every one of the determined Xc was 0%.

The results are shown in Table 5. The pressure of injection of the molten alloy (P) was regulated as specified below so as for the average thickness of the amorphous alloy ribbon to become 25 to 30 μm, while the casting temperature was regulated depending on the composition of the alloy.

Production Conditions

Material of the cooling wheel:

Cu-Be alloy containing 0.4% by weight of Be,

Surface velocity of the cooling wheel (R):

30 (m/sec),

Casting temperature (Tc): specified in Table 5, Molten alloy injection pressure (P) (gauge):

specified in Table 5,

Slot width at the nozzle tip (d):

0.3 (mm),

Gap between the nozzle tip and the cooling wheel (g):

0.2 (mm), and

Atmosphere:

air.

TABLE 5

| | Alloy composition (atomic %) | Casting temp. (Tc) °C. | Injection pressure (P) (gauge) kgf/cm$^2$ | Sticking angle (θ) ° |
|---|---|---|---|---|
| Ex. 5 | $Fe_{73}Cu_1Si_{15}B_8Nb_3$ | 1330 | 0.40 | >60 |
| Ex. 6 | $Fe_{73}Cu_1Si_{15}B_8W_3$ | 1350 | 0.35 | >60 |
| Ex. 7 | $Fe_{76}Cu_1Si_{11}B_9Mo_3$ | 1400 | 0.40 | >60 |
| E. 8 | $Fe_{76}Cu_1Si_{11}B_9Ta_3$ | 1400 | 0.40 | >60 |
| Ex. 9 | $Fe_{76}Cu_1Si_{11}B_9W_3$ | 1400 | 0.40 | >60 |
| Ex. 10 | $Fe_{76}Cu_1Si_{11}B_7Nb_3P_2$ | 1450 | 0.35 | >60 |
| Ex. 11 | $Fe_{76}Cu_1Si_{11}B_6W_3P_3$ | 1450 | 0.35 | >60 |
| Ex. 12 | $Fe_{76}Cu_1Si_{11}B_8Nb_3Cr_1$ | 1400 | 0.40 | >60 |
| Ex. 13 | $Fe_{73}Cu_1Si_{13.5}B_9Nb_3C_{0.5}$ | 1350 | 0.40 | >60 |
| Ex. 14 | $Fe_{78}Cu_1Si_9B_9Mo_3$ | 1400 | 0.40 | >60 |
| Ex. 15 | $Fe_{76.5}Cu_{0.5}Si_{11}B_9Nb_3$ | 1450 | 0.35 | >60 |
| Ex. 16 | $Fe_{75.5}Cu_{1.5}Si_{11}B_9Nb_3$ | 1450 | 0.35 | >60 |
| Ex. 17 | $Fe_{76.5}Cu_1Si_{11}B_9Nb_{2.5}$ | 1450 | 0.35 | >60 |
| Ex. 18 | $Fe_{74}Cu_1Si_{11}B_9Nb_5$ | 1450 | 0.35 | >60 |
| Ex. 19 | $Fe_{72}Ni_4Cu_1Si_{11}B_9Nb_3$ | 1400 | 0.35 | >60 |
| Ex. 20 | $Fe_{73}Co_3Cu_1Si_{11}B_9Nb_3$ | 1400 | 0.35 | >60 |

Example 21

Amorphous alloy ribbons each having a thickness of about 25 to 30 μm were produced from the alloys of the compositions represented by the formula:

$Fe_{96-y-z}Cu_1Si_yB_zNb_3$(atomic %)

according to the single roll method in various atmospheres and under the below specified conditions. The sticking angle (θ) of each of the alloy ribbons on the roll and the thickness (h) of each of the formed alloy ribbons were measured in the same manner as in Example 1. Further, the crystal content ($X_C$) of each of the obtained alloy ribbons was determined in the same manner as in Example 1.

The results are shown in Table 6.

Production Conditions

Material of the cooling wheel:

Cu-Be alloy containing 0.4% by weight of Be,

Surface velocity of the cooling wheel (R):

30 (m/sec),

Casting temperature (Tc):

1450 (°C.),

Molten alloy injection pressure (P) (gauge):

0.35 (kgf/cm$^2$),

Slot width at the nozzle tip (d):

0.3 (mm), and

Gap between the nozzle tip and the cooling wheel (g):

0.2 (mm)

TABLE 6

| Atmosphere | Amount of Si (y) atomic (%) | Amount of B (z) atomic % | Sticking angle (θ) ° | Thickness of alloy ribbon (h) μm | Xc (%) of alloy ribbon *1 |
|---|---|---|---|---|---|
| Example 21 | | | | | |
| Air | 9.5 | 9 | >60 | 27 | 0 |
| | 11 | 9 | >60 | 26 | 0 |
| | 13.5 | 9 | >60 | 27 | 0 |
| Ar | 9.5 | 9 | >60 | 28 | 0 |
| | 11 | 9 | >60 | 26 | 0 |
| | 13.5 | 9 | >60 | 28 | 0 |
| $N_2$ | 9.5 | 9 | >60 | 26 | 0 |
| | 11 | 9 | >60 | 26 | 0 |
| | 13.5 | 9 | >60 | 27 | 0 |

*1 Determined in the same manner as described in note *2 of Table 1.

Table 6 shows that the amorphous alloy ribbons satisfactorily stick to the cooling wheel even if the production is performed in nonair atmosphere.

Example 22

Amorphous alloy ribbons each having a thickness of about 25 to 30 μm were produced from the alloy of the composition represented by the formula:

$$Fe_{76}Cu_1Si_{11}B_9Nb_3(\text{atomic }\%)$$

according to the single roll method with various gaps (g) between the nozzle tip and the cooling wheel and under the below specified conditions. The sticking angle (θ) of each of the alloy ribbons on the roll and the thickness (h) of each of the formed alloy ribbons were measured in the same manner as in Example 1. Further, the $X_C$ of each of the obtained alloy ribbons was determined in the same manner as in Example 1.

The results are shown in Table 7.

The amorphous alloy ribbons satisfactorily stick to the cooling wheel even if the production is performed in nonair atmosphere.

Production Conditions

Material of the cooling wheel:

Cu-Be alloy containing 0.4% by weight of Be,

Surface velocity of the cooling wheel (R):

30 (m/sec),

Casting temperature (Tc):

1450 (°C.),

Molten alloy injection pressure (P) (gauge):

0.35 (kgf/cm$^2$),

Slot width at the nozzle tip (d):

0.3 (mm), and

Gap between the nozzle tip and the cooling wheel (g):

0.2 (mm).

TABLE 7

| | Gap (g) mm | Sticking angle (θ) ° | Thickness of alloy ribbon (h) μm | Xc (%) of alloy ribbon *1 |
|---|---|---|---|---|
| Example 22 | 0.1 | >60 | 26 | 0 |
| | 0.15 | >60 | 25 | 0 |
| | 0.2 | >60 | 26 | 0 |

*1 Determined in the same manner as described in note *2 of Table 1.

Example 23

Amorphous alloy ribbons each having a thickness of about 25 to 30 μm were produced from the alloys of the compositions represented by the formula:

$$Fe_{96-y-z}Cu_1Si_yB_zNb_3(\text{atomic }\%)$$

wherein y and z are specified in Table 8, according to the single roll method under the below specified conditions. The sticking angle (θ) of each of the alloy ribbons on the roll and the thickness (h) of each of the formed alloy ribbons were measured in the same manner as in Example 1. Further, the $X_C$ of each of the obtained alloy ribbons was determined in the same manner as in Example 1.

The results are shown in Table 8. The amorphous alloy ribbons satisfactorily stuck to the cooling wheel as in the use of the cooling wheel comprising a Cu-Be alloy containing 0.4% by weight of Be.

Production conditions

Material of the cooling wheel:

Cu-Be alloy containing 1.9% by weight of Be,

Surface velocity of the cooling wheel (R):

30 (m/sec),

Casting temperature (Tc):

1450 (°C.)

Molten alloy injection pressure (P) (gauge):

0.30 (kgf/cm$^2$),

Slot width at the nozzle tip (d):

0.3 (mm),

Gap between the nozzle tip and the cooling wheel (g):

0.15 (mm), and

Atmosphere:

air.

TABLE 8

| | Amount of Si (y) atomic % | Amount of B (z) atomic % | Sticking angle (θ) ° | Thickness of alloy ribbon (h) μm | Xc (%) of alloy ribbon *1 |
|---|---|---|---|---|---|
| Example 23 | 9.5 | 9 | >60 | 24 | 10 |
| | 11 | 9 | >60 | 23 | 0 |
| | 13.5 | 9 | >60 | 23 | 5 |

*1 Determined in the same manner as described in note *2 of Table 1.

What is claimed is:

1. A process for producing an amorphous alloy ribbon by the single roll method, which comprises injecting through a slot disposed at a nozzle tip, a molten alloy having the composition represented by the general formula:

$(Fe_{1-a}M_a)_{100-x-y-z-b}Cu_xSi_yB_aM'b$ wherein M is Co and/or Ni, M' is at least one element selected from the group consisting of Nb, Mo, W and Ta, and a, x, y, z and b satisfy the relationship: $0 \leqq a \leqq 0.1$, $0.5 \leqq x \leqq 2$ (atomic %) $5 \leqq y \leqq 20$ (atomic %), $5 \leqq z \leqq 11$ (atomic %), $14 \leqq y+z \leqq 25$ (atomic %) and $2 \leqq b \leqq 5$ (atomic %), provided that the ratio of y to z (y/z) is in the range of $0.5 \leqq y/z \leqq 3$, onto a rotating cooling wheel comprising a Cu alloy containing Be in an amount of 0.05 to 3.0% by weight, and rotating at a surface velocity in the range of from 10 m/sec to 40 m/sec; and wherein the injection pressure (P) (gauge) of the molten alloy is in the range of from 0.30 to 0.40 kgf/cm$^2$.

2. A process for producing an amorphous alloy ribbon by the single roll method, which comprises injecting through a slot disposed at a nozzle tip, a molten alloy having the composition represented by the general formula:

$Fe_{100-x-y-z-b}Cu_xSi_yB_zM'b$ wherein M' is at least one element selected from the group consisting of Nb, Mo, W and Ta, and x, y, z and b satisfy the relationship: $0.5 \leqq x \leqq 2$ (atomic %), $5 \leqq y \leqq 20$ (atomic %), $5 \leqq z \leqq 11$ (atomic %), $14 \leqq y+z \leqq 25$ (atomic %) and $2 \leqq b \leqq 5$ (atomic %), provided that the ratio of y to z (y/z) is in the range of $0.5 \leqq y/z \leqq 3$, onto a rotating cooling wheel comprising a Cu alloy containing Be in an amount of 0.05 to 3.0% by weight, and rotating at a surface velocity in the range of from 10 m/see to 40 m/sec; and wherein the injection pressure (P) (gauge) of the molten alloy is in the range of from 0.30 to 0.40 kgf/cm$^2$.

* * * * *

UNITED STATES PATENT AND TRADEMARK OFFICE

CERTIFICATE OF CORRECTION

PATENT NO. : 5,647,921

DATED : July 15, 1997

INVENTOR(S) : Kenji Odagawa; Hiroshi Watanabe

It is certified that error appears in the above-indentified patent and that said Letters Patent is hereby corrected as shown below:

On the title page, item [54],
IN THE TITLE:

Delete "PROCESS FOR PRODUCING AND AMORPHOUS ALLOY RESIN"

Insert --PROCESS FOR PRODUCING AN AMORPHOUS ALLOY RIBBON--

Signed and Sealed this

Third Day of March, 1998

*Attest:*

*Attesting Officer*

BRUCE LEHMAN

*Commissioner of Patents and Trademarks*